US005137118A

United States Patent [19]

Iwata

[11] Patent Number: 5,137,118

[45] Date of Patent: Aug. 11, 1992

[54] APPARATUS FOR CONTROLLING THE OPENING AND CLOSING OF ELECTRIC DOORS

[75] Inventor: Shigemi Iwata, Inazawa, Japan

[73] Assignee: Mitsubishi Denki Kabushiki Kaisha, Tokyo, Japan

[21] Appl. No.: 574,897

[22] Filed: Aug. 30, 1990

[30] Foreign Application Priority Data

Sep. 8, 1989 [JP] Japan ..... 1-233359

[51] Int. Cl.[5] ..... B66B 13/14

[52] U.S. Cl. ..... 187/103

[58] Field of Search ..... 187/1090, 103, 105, 187/133

[56] References Cited

U.S. PATENT DOCUMENTS

| | | | |
|---|---|---|---|
| 4,101,007 | 7/1978 | Magee | 187/105 |
| 4,299,308 | 11/1981 | Shung et al. | 187/103 |
| 4,300,660 | 11/1981 | Schoenmann et al. | 187/103 |
| 4,300,663 | 11/1981 | Hmelovsky et al. | 187/103 |
| 4,342,379 | 8/1982 | Games et al. | 187/103 |
| 4,367,810 | 1/1983 | Doane et al. | 187/100 |
| 4,832,158 | 5/1989 | Farrar et al. | 187/103 |
| 4,930,604 | 6/1990 | Schienda et al. | 187/133 |

*Primary Examiner*—Howard L. Williams
*Assistant Examiner*—Lawrence E. Colbert
*Attorney, Agent, or Firm*—Leydig, Voit & Mayer

[57] ABSTRACT

An elevator control apparatus comprises a drive for driving the car door of an elevator, an operation management control device which is installed in a machine room of the elevator and which generates not only a command signal for controlling the operation management of the car, but also a door open ready signal, a door control device which is installed in the car and which controls the drive device based upon the command signal generated by the operation management control device. The door control device also generates status signal indicating the status of the door. The elevator control apparatus further comprises a first serial-parallel converter for serializing the command signal generated by the operation management control device, a second serial-parallel converter which deserializes the command signal serialized by the first serial-parallel converter and which serializes the status signals generated by the door control device, a serial transmission line which connects the first and second serial-parallel converters to each other and which transmits the serialized command signal and the serialized status signals, an open ready signal line which connects the operation management control device and the door control device to each other, and which transmits the door open ready signal from the operation management control device to the door control device.

7 Claims, 4 Drawing Sheets

APPARATUS FOR CONTROLLING THE OPENING AND CLOSING OF ELECTRIC DOORS

BACKGROUND OF THE INVENTION

1. Field of the Invention

The present invention relates to an elevator control apparatus, and more particularly to an elevator control apparatus which can reduce the number of signal lines connected between an operation management control device for controlling the operation management of an elevator car and a door control device for controlling the elevator door.

2. Description of the Related Art

A large number of highly reliable microcomputers and LSI circuits have been available at a low price in recent years. Microcomputers have been utilized for the sub systems of elevator control apparatuses.

A conventional elevator control apparatus illustrated in FIG. 1 has an operation management control device 11 installed in a machine room 10 and a door control device 21 installed in a car 20. The operation management control device 11 and the door control device 21 respectively comprise a microcomputer and the like, and are connected to each other through a number of parallel signal lines 30. The signal lines 30 include not only a number of signal lines 31 which transmit signals from the operation management control device 11 to the door control device 21, but also a number of signal lines 32 which in turn transmit signals from the door control device 21 to the operation management control device 11.

Connected to the door control device 21 is a door drive device 40 for driving the unillustrated door of the car 20 which includes a three-phase AC power supply 22, an electric power converting device 23, a motor 24 for the door, and a pulse generator 25 for detecting the number of revolutions of the motor 24. The electric power converting device 23 comprises an inverter which has a thyristor, a transistor or the like.

In the conventional elevator control apparatus as constructed above, the operation management control device 11 not only controls processing of calls from the car 20 and floors (not shown), but also controls the running, stopping, speed, etc. of the car 20. In addition, the operation management control device 11 also generates, in parallel, command signals commanding operations such as the opening and closing of the door of the car 20. These command signals are sent, in parallel, to the door control device 21 via the signal lines 31. The door control device 21 inputs the received command signals and generates, based upon these command signals, reference speed commands which command the rotation directions (directions in which the door opens and closes), and the number of revolutions, of the motor 24 for the door. The door control device 21 then generates torque commands based upon deviations between the reference speed command and the number of revolutions of the motor 24 for the door which is detected by the pulse generator 25, i.e., the actual speed, and further outputs these torque commands to the electric power converting device 23. The electric power converting device 23 controls the number of revolutions of the motor 24 for the door and thereby controls the door. The door control device 21 also generates and outputs status signals indicating the full opening and closing of the door, abnormalities in the opening or closing of the door, and so forth. These status signals are sent, in parallel, to the operation management control device 11 through the signal lines 32. The status signals include a detection signal from a mechanical contact sensor, or a photoelectric or supersonic wave non-contact sensor. Any one of the above sensors is attached to the edge of the door and generates a signal when a passenger touches or approaches the door while the door is closing. Upon receiving the detection signal from such a sensor, the operation management control device 11 switches to the door open command signal from the door close command signal in order to drive the door in the open direction.

There are, however, problems with the conventional elevator control apparatus in that because the operation management control device 11 and the door control device 21 are connected to each other through a large number of parallel signal lines 30, (i) the cost of the signal lines 30 becomes high; (ii) because of a large number of the signal lines 30, the installation of the elevator requires time and the maintenance time for the elevator becomes lengthy; and (iii) since all the signal lines 30 are connected in parallel, the operation management control device 11 and the door control device 21, each of which comprises a microcomputer, respectively require a large number of input/output process circuits, thereby resulting in complicated structures.

SUMMARY OF THE INVENTION

The present invention overcomes the foregoing problems. An object of the present invention is to obtain an elevator control apparatus which is quite safe and is easy to be installed and maintained, and which reduces the cost.

The present invention provides an elevator control apparatus, comprising drive means for opening and closing the car door of an elevator; operation management control means which is installed in a machine room of the elevator and which generates, in parallel, a command signal for controlling the operation management of the car, the operation management control means generating a door open ready signal when the door is in the state where it can open; door control means which is installed in the car and which controls the drive means based upon the command signal generated by the operation management control means, the door control means generating, in parallel, status signals indicating the status of the door; a first serial-parallel converter for serializing the command signal generated by the operation management control means; a second serial-parallel converter which deserializes the command signal serialized by the first serial-parallel converter and which serializes the status signals generated by the door control means; serial transmission means which connects the first and second serial-parallel converters to each other and which transmits the serialized command signal and the serialized status signals, the serial transmission means including two transmission lines at most; and an open ready signal line which connects the operation management control means and the door control means to each other, and which transmits the door open ready signal from the operation management control means to the door control means; the first serial-parallel converter deserializing the status signals which have been serialized by the second serial-parallel converter, the door control means controlling the drive means to open the door only when both a command signal, which commands the opening of the door, via the serial transmission means and the door open ready signal via the open ready signal line are input from the operation management control means.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

The embodiments of the present invention will be hereinafter described with reference to the accompanying drawings.

Figure 1:
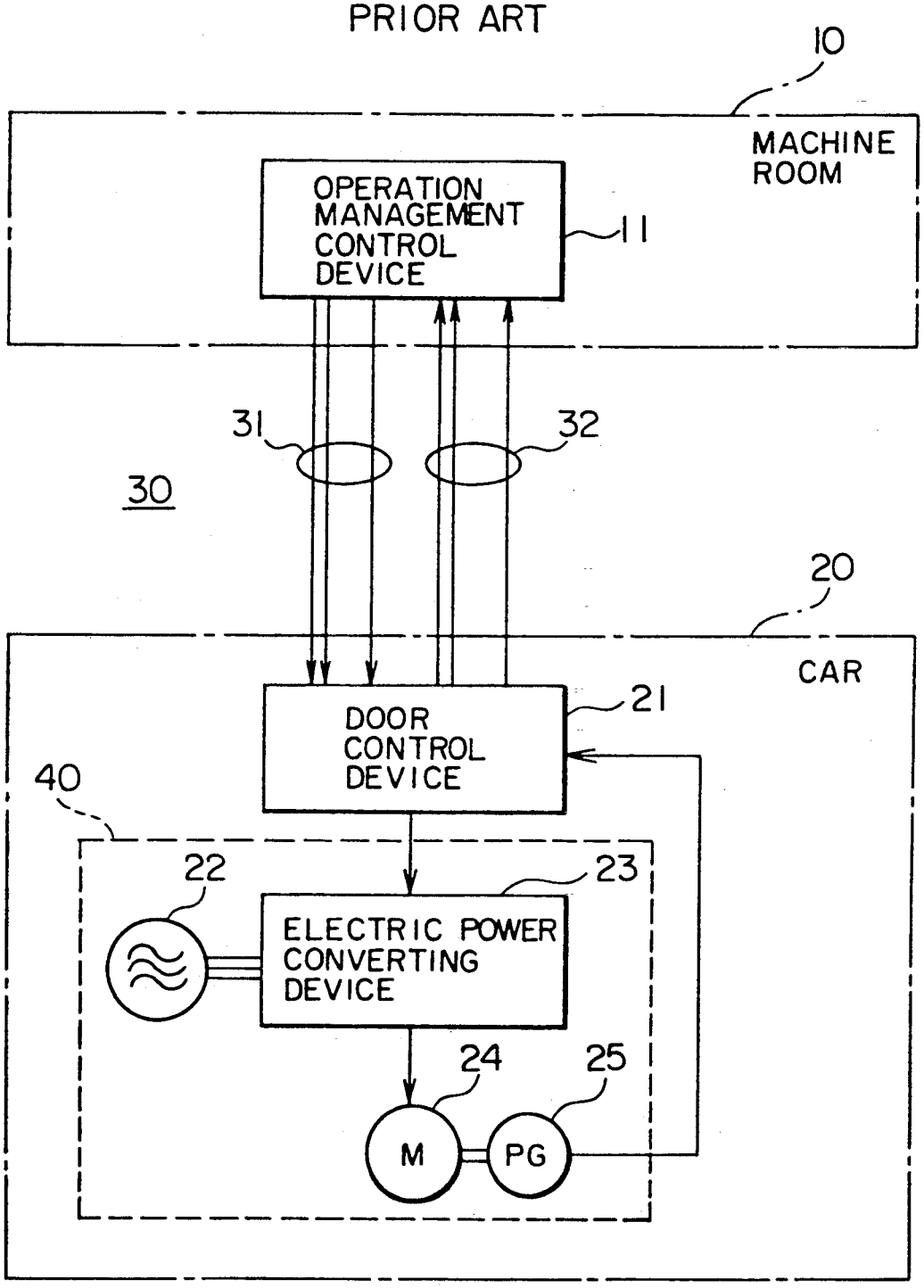
FIG. 1 PRIOR ART
FIG. 1 is a block diagram illustrating a conventional elevator control apparatus.
Figure 2:
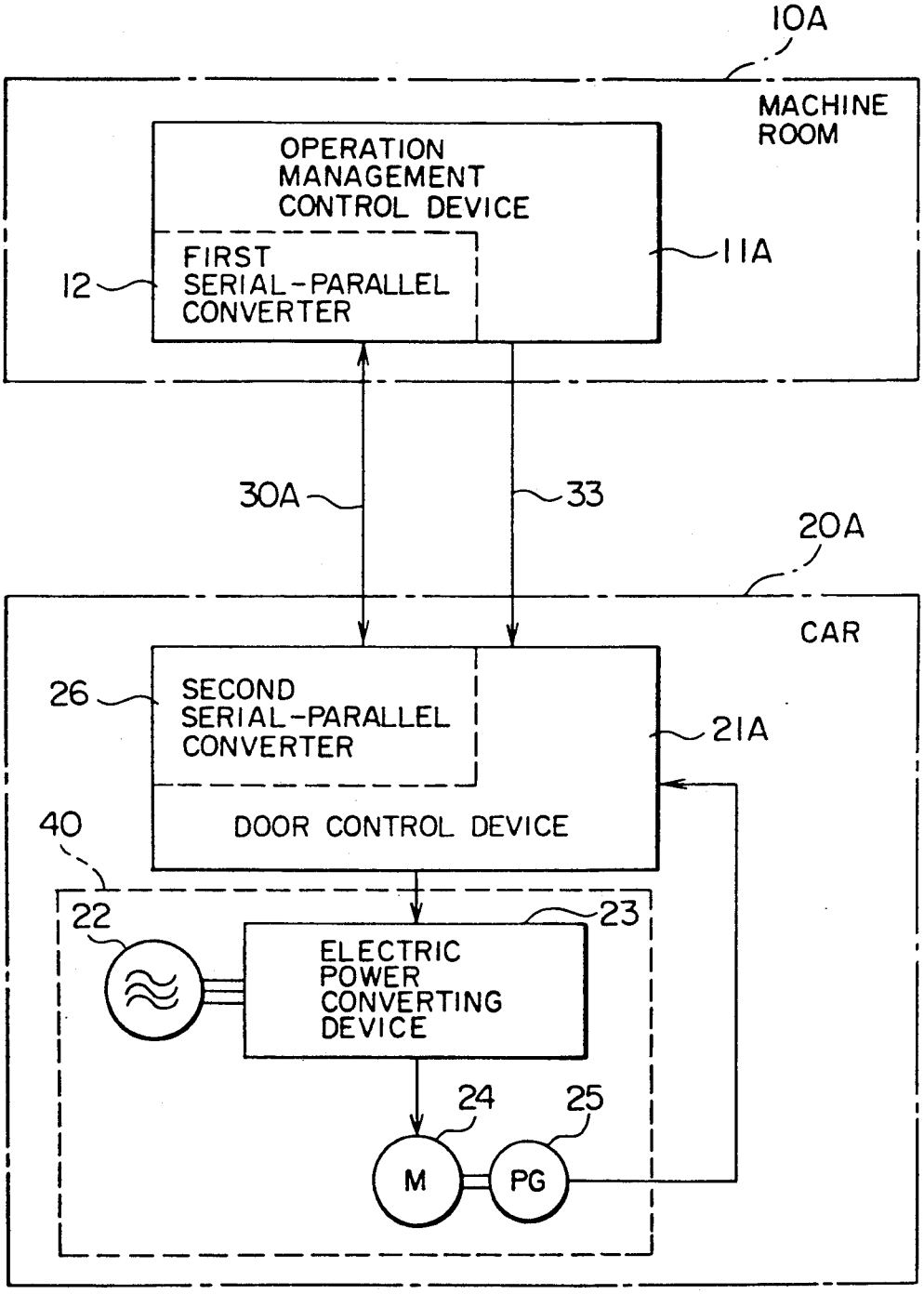
FIG. 2 is a block diagram illustrating an embodiment of the elevator control apparatus according to the present invention.

In FIG. 2, an elevator control apparatus according to an embodiment of the present invention has an operation management control device 11A installed in a machine room 10A and a door control device 21A installed in a car 20A. The operation management control device 11A and the door control device 21A respectively comprise a microcomputer and the like, and are connected to each other by a door open ready signal line 33. The operation management control device 11A incorporates a first serial-parallel converter 12, whereas the door control device 21A incorporates a second serial-parallel converter 26. The first and second serial-parallel converters 12, 26 are connected to each other by one serial transmission line 30A.

Connected to the door control device 21A is a door drive device 40 for driving the unillustrated door of the car 20A which includes a three-phase AC power supply 22, an electric power converting device 23, a motor 24 for opening and closing the door, and a pulse generator 25 for detecting the number of revolutions of the motor 24. The electric power converting device 23 comprises an inverter which has a thyristor, a transistor or the like.

The operation management control device 11A not only controls processes for calls from the car 20A and floors (not shown), but also controls the running, stopping, speed, etc. of the car 20A. The operation management control device 11A also generates, in parallel, command signals (including signals which make the commands invalid) commanding operations such as the opening and closing of the door of the car 20A. When the door of the car 20A is in the state where it can open, the operation management control device 11A further outputs a door open ready signal to the door open ready signal line 33. The door control device 21A controls the electric power converting device 23 based upon a command signal and the door open ready signal. The command signal is input via the first serial-parallel converter 12, the serial transmission line 30A, and the second serial-parallel converter 26 from the operation management control device 11A, whereas the door open ready signal is input via the door open ready signal line 33 from the operation management control device 11A. The door control device 21A further generates, in parallel, status signals indicating the full opening and closing of the door, abnormalities in the opening or closing of the door, and so forth.

The first serial-parallel converter 12 not only serializes a command signal generated, in parallel, from the operation management control device 11A in order to output it to the serial transmission line 30A, but also deserializes the serial status signal which is input from the door control device 21A through the serial transmission line 30A. The second serial-parallel converter 26 not only serializes the status signal generated, in parallel, from the door control device 21A in order to output it to the serial transmission line 30A, but also deserializes the serial command signal which is input from the operation management control device 11A through the serial transmission line 30A.

As described above, serial transmission of the command signals or status signals through one serial transmission line 30A between the operation management control device 11A and the door control device 21A is capable of eliminating the need for a large number of signal lines. This permits reductions in the signal line costs and saves time required for the installation and maintenance of the signal lines.

If all the command and status signals are serialized, however, in case of an error in serial transmission while the car 20A is running, for example, the door control device 21A may cause the door to open, despite the fact that a command signal for opening the door has not been transmitted. This may decrease the safety of passengers as well as the reliability of the elevator.

Therefore, according to the present invention, even if a door open command signal is transmitted via the serial transmission line 30A from the operation management control device 11A, the door control device 21A will not cause the door to open, unless the door open ready signal is transmitted via the signal line 33.

Figure 3:
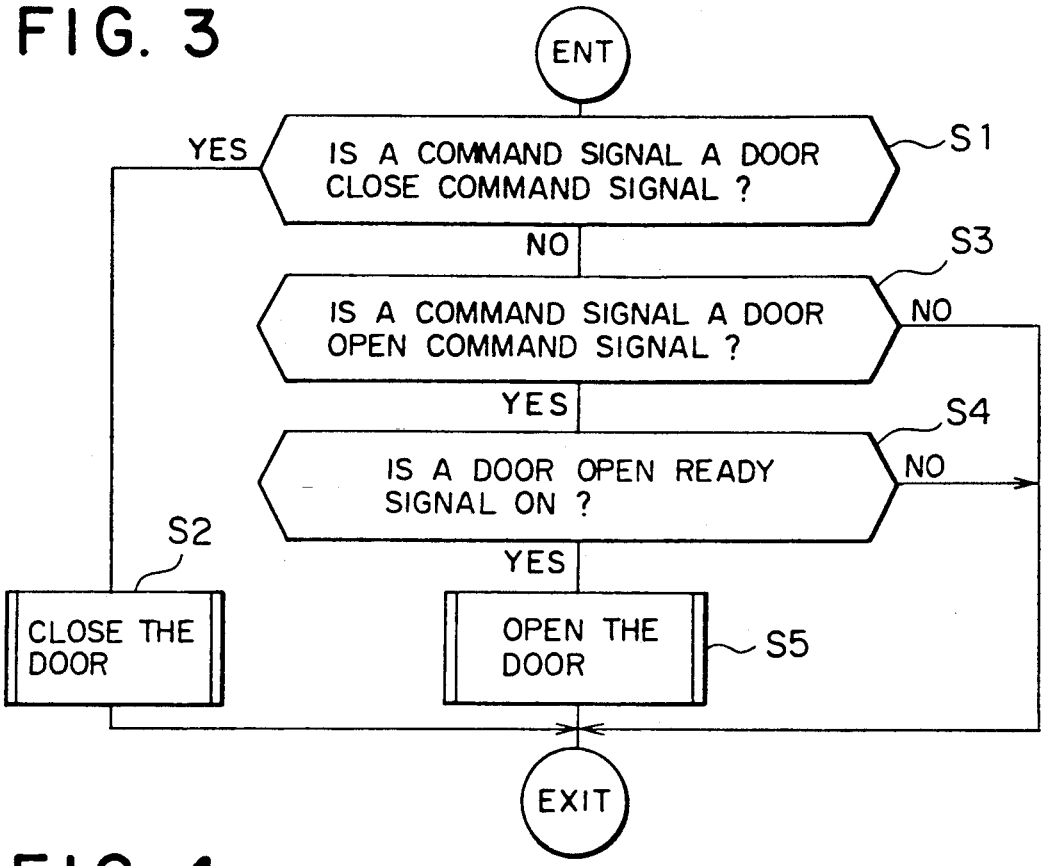
FIGS. 3 and 4 are flow charts showing the operation of the embodiment illustrated in FIG. 2.
Figure 4:
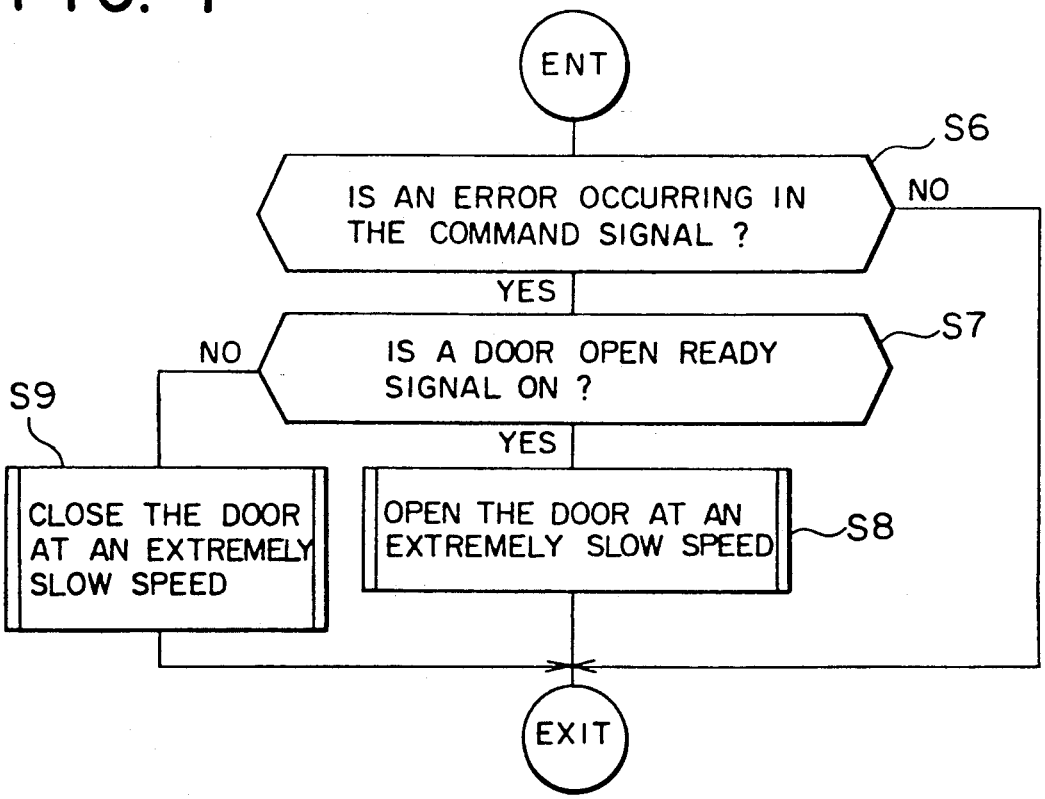

FIGS. 3 and 4 are flow charts explaining the operation of the door control device 21A illustrated in FIG. 2. In step S1 of FIG. 3, it is determined whether or not a command signal transmitted from the operation management control device 11A via the serial transmission line 30A is a door close command signal. If the command signal is a door close command signal, the logical sequence of a program required for the operation of the door control device 21A proceeds to step S2, where the door control device 21A closes the door. In other words, the door control device 21A generates a reference speed command, and produces a torque command base upon deviations between the reference speed command and the actual speed which is detected by the pulse generator 25. The door control device 21A then outputs this torque command to the electric power converting device 23. As a result, the motor 24 for the door rotates at appropriate speeds in an appropriate direction so as to close the door. On the contrary, in step S1, if the command signal transmitted from the operation management control device 11A via the serial transmission line 30A is not a door close command signal, the logical sequence proceeds to step S3, in which it is determined whether or not the command signal is a door open command signal. If the command signal is a door open command signal, the logical sequence proceeds to step S4, where it is determined whether or not the door open ready signal transmitted from the operation management control device 11A through the signal line 33 is ON. If the door open ready signal is ON, the logical sequence proceeds to step S5, in which the door control device 21A opens the door. In step S3, if the command signal is not a door open command signal, and in step S4, if the door open ready signal transmitted from the operation management control device 11A through the signal line 33 is not ON, the logical sequence of the program required for the operation of the door control device 21A proceeds to step S6 of FIG. 4.

In step S6, it is determined whether or not an error is occurring in the command signal. Some of errors are caused when noise is carried in the command signal, when the serial transmission line 30A is disconnected, and when the first or second serial-parallel converter 12 or 26 goes out of order. Well-known techniques, such as parity error detection, checksum error detection, or CRC error detection, are utilized to detect the errors. In step S6, if an error is occurring in the command signal, the logical sequence proceeds to step S7, in which it is determined whether or not the door open ready signal is ON. If the door open ready signal is ON, the logical sequence proceeds to step S8, where the door control device 21A opens the door at an extremely slow speed. On the contrary, in step S7, if the door open ready signal is not ON, the logical sequence proceeds to step S9, where the door control device 21A closes the door at an extremely slow speed. Opening and closing the door at extremely slow speeds are operations to open and close the door at speeds from one-half to one-fourth the speeds of opening the door in step S5 and of closing the door in step S2. This extremely slow speed operation prevents passengers from being confined in the car, even if an error occurs in the serial transmission of the command signals. The extremely slow speeds are speeds where passengers are safe, even if a contact or non-contact sensor attached to the edge of the door does not function so that the door bumps against the passengers. For these reasons, in the case of errors caused by noise, the safety of passengers is secured from unstable opening and closing of the door, which results from the occurrence and disappearance of the errors in indefinite cycles. In addition, the door of the car 20A is prevented from being left open because the door closes at an extremely slow speed in step S9.

Figure 5:
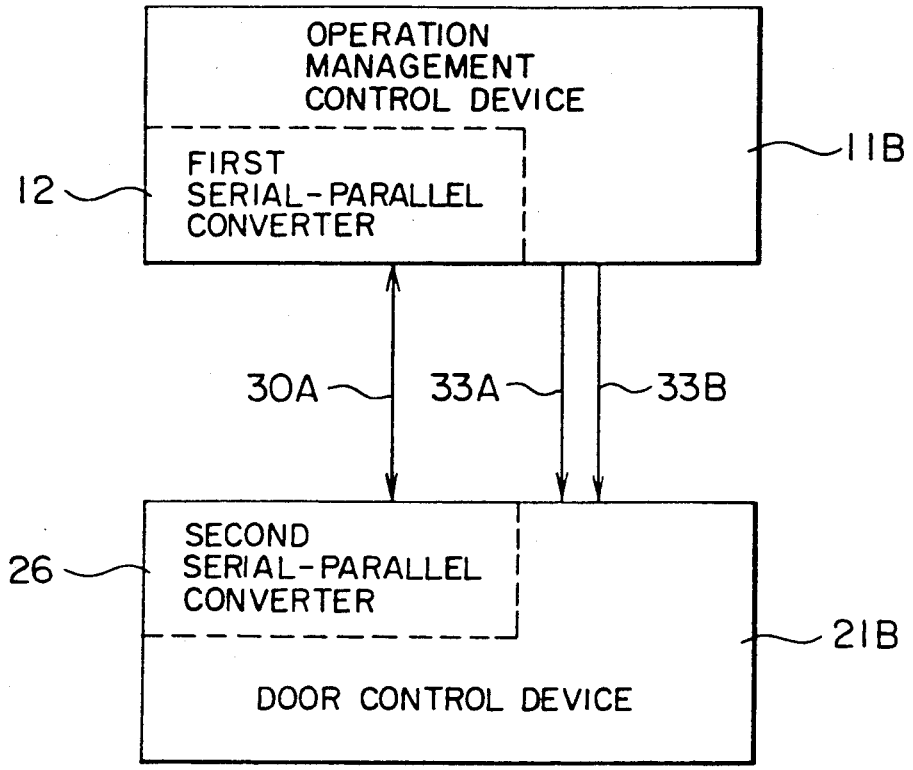
FIGS. 5 and 6 are block diagrams showing the main parts of other embodiments in accordance with the present invention.

In the foregoing embodiment, although a signal line 33 is provided in parallel to the serial transmission line 30A in order to transmit the door open ready signal, as illustrated in FIG. 5, two signal lines 33A and 33B connected to an operation management control device 11B and a door control device 21B may be provided in order to respectively transmit the door open ready signal and a door close ready signal. The operation management control device 11B outputs the door open ready signal to the signal line 33A, when the door of the car 20 is in the state where it can open, whereas it outputs the door close ready signal to the signal line 33B, when the door is in the state where it can close. The door control device 21B opens the door only when both the door open command signal and the door open ready signal are input, and closes the door only when both the door close command signal and the door close ready signal are input. The above arrangement further improves the safety and reliability of the elevator.

Figure 6:
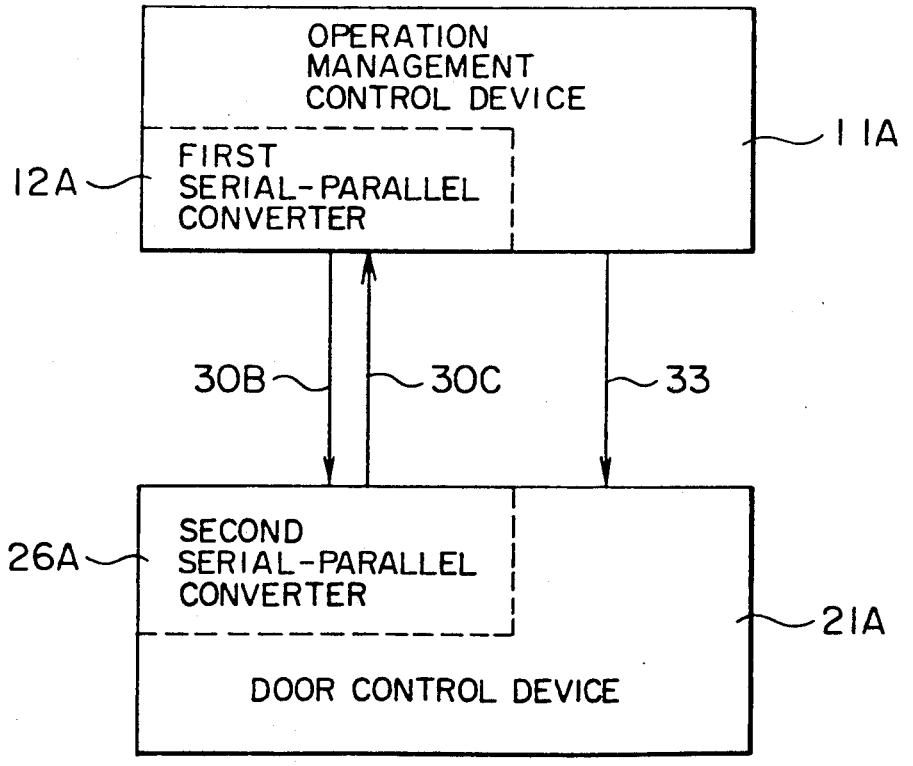

Furthermore, as shown in FIG. 6, a first serial-parallel converter 12A and a second serial-parallel converter 26A may be connected to each other by means of two serial transmission lines 30B and 30C. The serial transmission line 30B is exclusively used for signals which are output from the operation management control device 11A to the door control device 21A, while on the contrary, the serial transmission line 30C is exclusively used for signals which are output from the door control device 21A to the operation management control device 11A. The above provision of the two serial transmission lines 30B, 30C increases the serial transmission speeds of the command and status signals.

The above has been offered for illustrative purposes only, and is not intended to limit the scope of the invention of this application, which is as defined in the claims below.

What is claimed is:

1. An elevator control apparatus comprising:

drive means for opening and closing the car door of an elevator;

operation management control means which is installed in a machine room of the elevator and which generates, in parallel, a command signal for controlling the operation management of the car, said operation management control means generating a door open ready signal when said door is in the state where it can open;

door control means including a program controlled microcomputer which is installed in said car and which controls said drive means based upon the command signal generated by said operation management control means, said door control means generating, in parallel, status signals indicating the status of said door:

a first serial-parallel converter for serializing the command signal generated by said operation management control means;

a second serial-parallel converter which deserializes the command signal serialized by said first serial-parallel converter and which serializes the status signals generated by said door control lines;

serial transmission means which connects said first and second serial-parallel converters to each other and which transmits the serialized command signal and the serialized status signals, said serial transmission means including two transmission lines; and an open ready signal line separate from said transmission lines which connects said operation management control means and said door control means to each other, and which transmits the door open ready signal from said operation management control means to said door control means;

said first serial-parallel converter deserializing the status signals which have been serialized by said second serial-parallel converter, said door control means microcomputer operating under a program which directs said drive means to open said door only when the program determines that both a command signal, which commands the opening of said door, has been received via said serial transmission means and the door open ready signal has been received via door open ready signal line from said operation management control means.

2. An elevator control apparatus according to claim 1 wherein said serial transmission means includes one transmission line.

3. An elevator control apparatus according to claim 1 wherein said serial transmission means includes a first transmission line for transmitting the command signal from said operation management control means to said door control means and a second transmission line for transmitting the status signals from said door control means to said operation management control means.

4. An elevator control apparatus according to claim 1 further comprising a close ready signal line separate from the open ready signal line which connects said operation management control means and said door control means to each other, said operation management control means transmitting a ready signal line when said door is in the state where it can close which is utilized in a program operating the microcomputer to direct the drive means to actuate the door.

5. An elevator control apparatus according to claim 4 wherein said door control means microcomputer operates under a program which directs said drive means to close said door only when the program determines that both a command signal, which commands the closing of said door, has been received via said serial transmission means and the door close ready signal has been received via said close ready signal line from said operation management control means.

6. An elevator control apparatus according to claim 1 wherein a program which controls said door control means microcomputer determines whether or not an error is occurring to the command signal which has been input via said serial transmission means from said operation management control means, and directs said door control means so that it opens and/or closes said door at extremely slow speeds when an error is occurring.

7. An elevator control apparatus according to claim 1 wherein said drive means includes a three-phase AC power supply, an electric power converting device connected to said three-phase AC power supply, a motor for opening and closing said door by utilizing the electric power supplied from said electric power converting device, and a pulse generator for detecting the number of revolutions of said motor, said door control means being connected to said electric power converting device and said pulse generator.

* * * * *

UNITED STATES PATENT AND TRADEMARK OFFICE

CERTIFICATE OF CORRECTION

PATENT NO. : 5,137,118

DATED : AUGUST 11, 1992

INVENTOR(S) : SHIGEMI IWATA

It is certified that error appears in the above-identified patent and that said Letters Patent is hereby corrected as shown below:

Title page, item [54] and column 1, line 3, change "Electric" to --Elevator--.

Claim 1, column 6, line 31, change ":" to --;--;

Claim 1, column 6, line 38, change "lines" to --means--.

Signed and Sealed this

Twenty-first Day of September, 1993

Bruce Lehman

*Attest:*

BRUCE LEHMAN

*Attesting Officer*

*Commissioner of Patents and Trademarks*